US008438861B2

(12) United States Patent
Harttig

(10) Patent No.: US 8,438,861 B2
(45) Date of Patent: May 14, 2013

(54) COOLER / HEATER ARRANGEMENT

(76) Inventor: Herbert Harttig, Neustadt (DE)

( * ) Notice: Subject to any disclaimer, the term of this patent is extended or adjusted under 35 U.S.C. 154(b) by 1031 days.

(21) Appl. No.: 12/467,869

(22) Filed: May 18, 2009

(65) Prior Publication Data

US 2010/0122807 A1 May 20, 2010

(30) Foreign Application Priority Data

May 19, 2008 (EP) ..... 08104005

(51) Int. Cl.
*F25B 21/02* (2006.01)

(52) U.S. Cl.
USPC ..... 62/3.2

(58) Field of Classification Search ..... 62/3.2, 62/3.3, 3.6, 3.7; 165/185, 48.1
See application file for complete search history.

(56) References Cited

U.S. PATENT DOCUMENTS

| | | | | |
|---|---|---|---|---|
| 6,164,076 | A | 12/2000 | Chu et al. | |
| 6,230,497 | B1 * | 5/2001 | Morris et al. | 62/3.7 |
| 6,711,904 | B1 * | 3/2004 | Law et al. | 62/3.2 |
| 8,117,848 | B2 * | 2/2012 | Liebmann et al. | 62/3.3 |
| 2005/0009070 | A1 | 1/2005 | Arciniegas et al. | |

FOREIGN PATENT DOCUMENTS

| | | | |
|---|---|---|---|
| EP | 0452189 | A1 | 3/1991 |
| EP | 1710017 | A1 | 10/2006 |
| EP | 08104005.7 | | 9/2008 |

* cited by examiner

*Primary Examiner* — Melvin Jones
(74) *Attorney, Agent, or Firm* — M. Reza Savari

(57) ABSTRACT

The present invention relates to a device for heating and cooling an object in a controlled manner permitting a good thermal contact between the thermal block, the element for heating and cooling and the heat sink without the need for using a thermal interface material, an instrument comprising such a device and a method for conducting a thermal profile using the device.

12 Claims, 16 Drawing Sheets

COOLER / HEATER ARRANGEMENT

CROSS-REFERENCE TO RELATED APPLICATION

The present application claims the benefit of EP Appl. No. 08104005.7 filed May 19, 2008, the content of which is hereby incorporated herein by reference in its entirety.

FIELD OF THE INVENTION

The present invention relates to a device for heating and cooling an object in a controlled manner, an instrument for performing thermal cycles, and a method for conducting a thermal profile.

DESCRIPTION OF PRIOR ART

Methods and devices for amplifying nucleic acids are well known in the art.

A method that uses reactions cycles including denaturation and amplification steps is the polymerase chain reaction (PCR). This technology has revolutionized the field of nucleic acid treatment, particularly the analysis of nucleic acids, by providing a tool to increase the amount of nucleic acids of a particular sequence from negligible to detectable amounts. PCR is described e.g. in EP 0 201 184 and EP 0 200 362. More recently improved and more powerful PCR techniques have been developed. Quantitative real time PCR is a laboratory technique used to simultaneously amplify and quantify a specific part of a given DNA molecule. It is used to determine whether or not a specific sequence is present in the sample and if present, the number of copies in the sample can be quantified. Two common methods of quantification are the use of fluorescent dyes that intercalate with double-strand DNA and modified DNA oligonucleotide probes that fluoresce when hybridized with a complementary DNA. Such methods are described e.g. in EP 0 512 334.

In addition, multiplex PCR was developed that enables amplification of two or more products in parallel in a single reaction tube. It is widely used in genotyping applications and different areas of DNA testing in research, forensic, and diagnostic laboratories. Multiplex PCR can also be used for qualitative and semi-quantitative gene expression analysis using cDNA as a starting template originating from a variety of eukaryotic and prokaryotic sources.

An instrument for performing thermal cycles in controlled manner on samples in tubes using heating and cooling an extended metal block is disclosed in EP 0 236 069. In addition, various instruments for performing, detecting and monitoring such methods are known in the art, e.g. the Roche Cobas® TaqMan® instrument as described in EP 0 953 837 and the Roche LightCycler® 480 instrument.

In most of these instruments thermal cyclers are used having a thermal block comprising recesses where receptacles holding the PCR reaction mixtures can be inserted. Raising and lowering the temperature of the block in discrete, preprogrammed steps is presently mainly done using Peltier elements with active heating and cooling. A Peltier element is a solid-state active heat pump which transfers heat from one side of the device to the other side against the temperature gradient under consumption of electrical energy. Generally it is made up from two chips in between which conducting paths carrying quadrate p- and n-dotted semi-conductor cubes are placed. The application of continuous current results in a heat absorption on one side of the Peltier element resulting in a temperature decrease on this side, while on the other side heat is released resulting in a temperature increase. Upon reversal of the direction of the current flow also the direction of the heat transport may be changed. In addition thermal cyclers comprise a heat sink for absorbing and dissipating heat from another object using thermal contact.

In order to allow for an efficient heat transition the Peltier elements are coupled to the thermal block on one major surface and to the heat sink on the other major surface on the opposite side using high mechanical force. In order to compensate for the unevenness of the respective surfaces which are in physical contact resulting in a diminished contact and an increased heat transfer resistance thermal interface materials are used. Such thermal interface materials commonly are films made up from graphite as, e.g., disclosed in US 2006/0086118 or films additionally modified having diamante layers on both major surfaces as, e.g., disclosed in U.S. Pat. No. 6,164,076.

However, as numerous thermal profiles are performed on such thermal cyclers there is an increased risk that the thermal interface materials may be harmed and degraded or displaced, e.g., by friction while thermal profiles are applied particularly when the dimensions of the Peltier element and the thermal block are very unequal resulting in a divers expansion of the Peltier element and the thermal block caused by the heat applied.

SUMMARY OF THE INVENTION

In one aspect, the invention relates to a device for heating and cooling an object in a controlled manner, said device comprising layered on top of another in the following order from top to bottom:

a thermal block, an element for heating and cooling, and a heat sink, wherein the surface of the thermal block facing the element for heating and cooling and/or the surface of the element for heating and cooling facing the thermal block is covered with a solid film lubricant.

In another aspect, the invention relates an instrument for performing thermal cycles at least comprising a device for heating and cooling according to the invention.

In yet another aspect, the invention relates to a method for conducting a thermal profile comprising:

providing a receptacle on a thermal block of a device for heating and cooling according to the invention, providing a fluid to be heated and/or cooled in said receptacle, applying heat or cold to said fluid in said receptacle using said element device for heating and cooling.

DETAILED DESCRIPTION OF THE INVENTION

It is an object of the present invention to overcome the problems encountered in the prior art mentioned hereinabove when calibrating or testing the optical detection unit of an instrument for the optical detection of an array of chemical or biological samples.

As explained above, an object of the present invention is therefore to provide a device for heating and cooling an object in a controlled manner, permitting a good thermal contact between the thermal block and the Peltier element without the need for using a thermal interface material.

Figure 1:
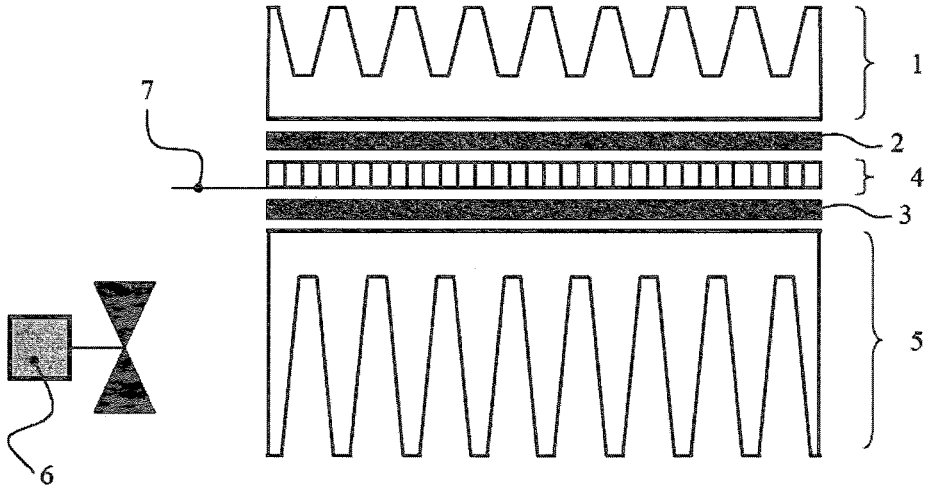
FIG. 1 shows a cross-sectional and exploded view of a device for heating and cooling of the prior art.

Referring to the Figures, FIG. 1 shows a device for heating and cooling known in the art having a thermal block (1), an element for heating and cooling (4), and a heat sink (5), wherein a film for heat transfer is present between the thermal block and the element for heating and cooling (2) as well as between the element for heating and cooling and the heat sink (3).

Figure 2A:
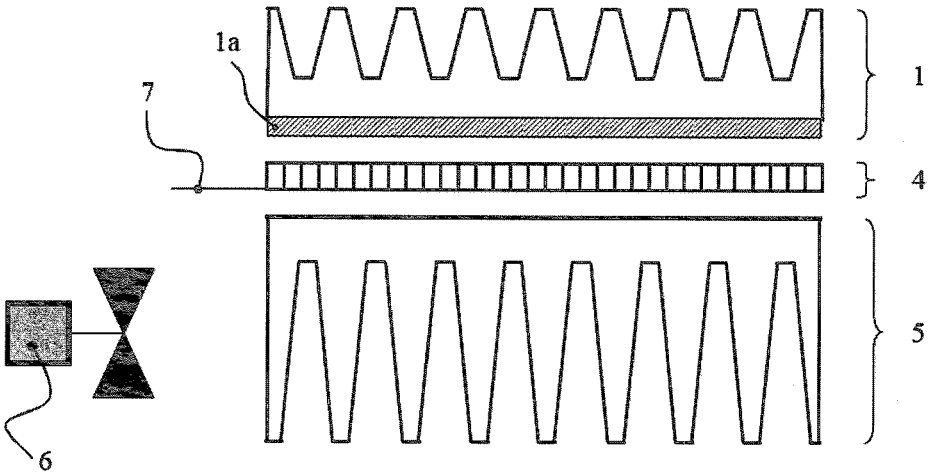
FIGS. 2A, 2B and 2C show a cross-sectional and exploded view of a certain embodiment of a device for heating and cooling according to the invention.
Figure 2B:
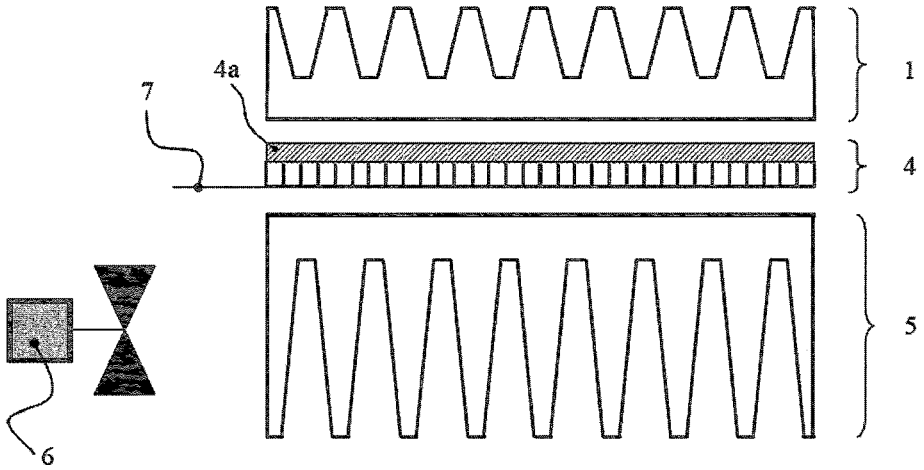
Figure 2C:
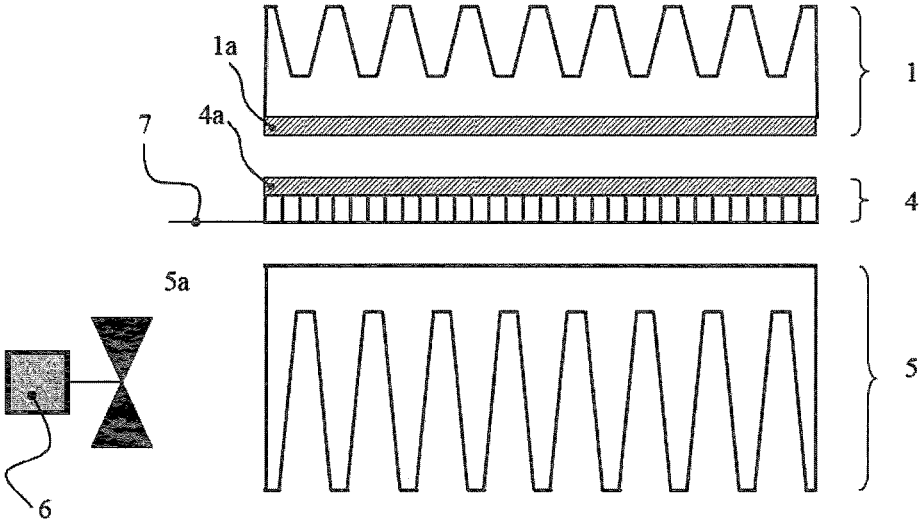
Figure 3A:
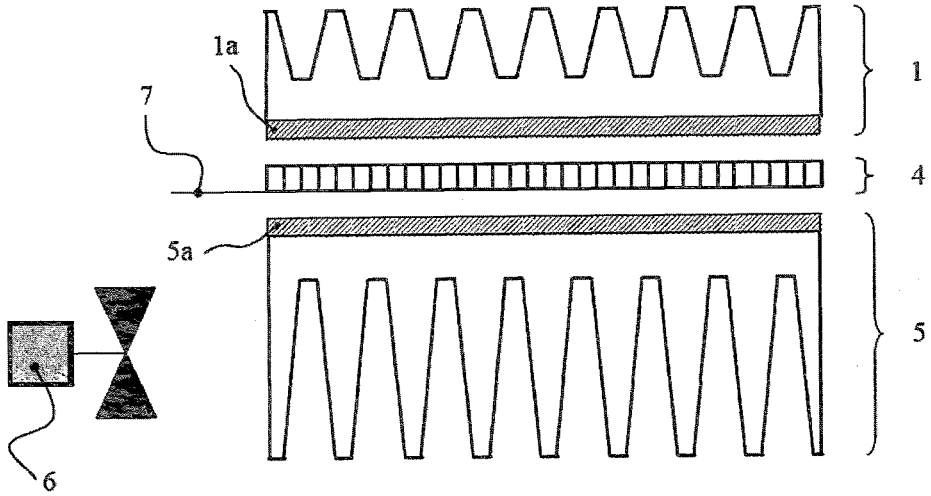
FIGS. 3A, 3B, 3C and 3D show a cross-sectional and exploded view of another embodiment of a device for heating and cooling according to the invention.
Figure 3B:
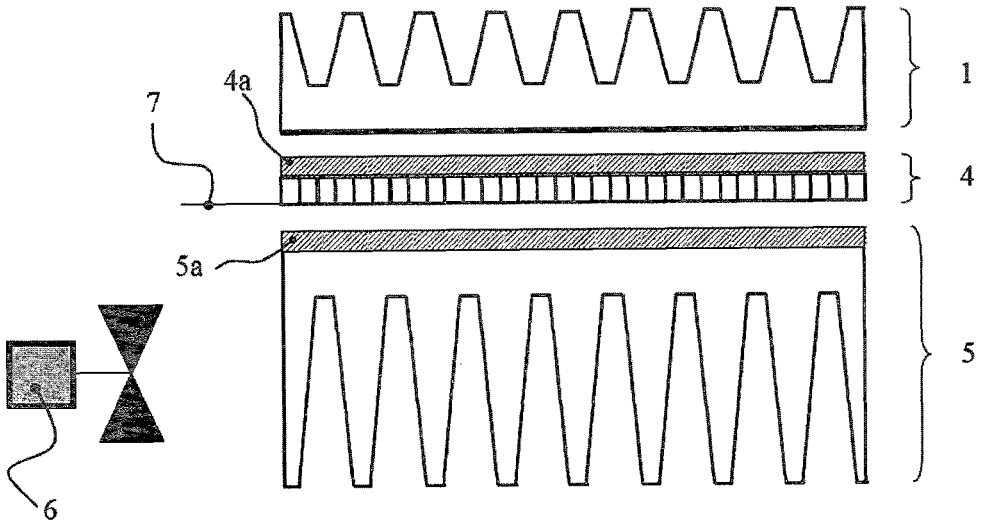
Figure 3C:
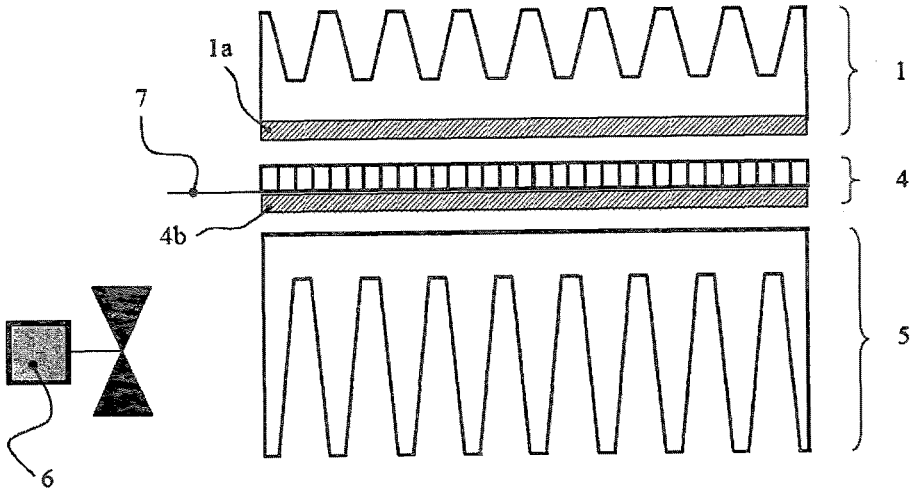
Figure 3D:
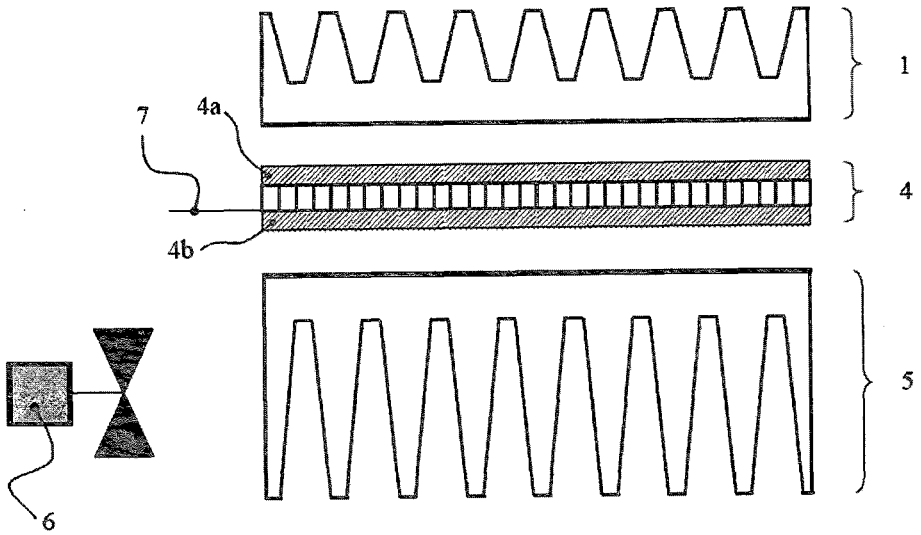
Figure 4A:
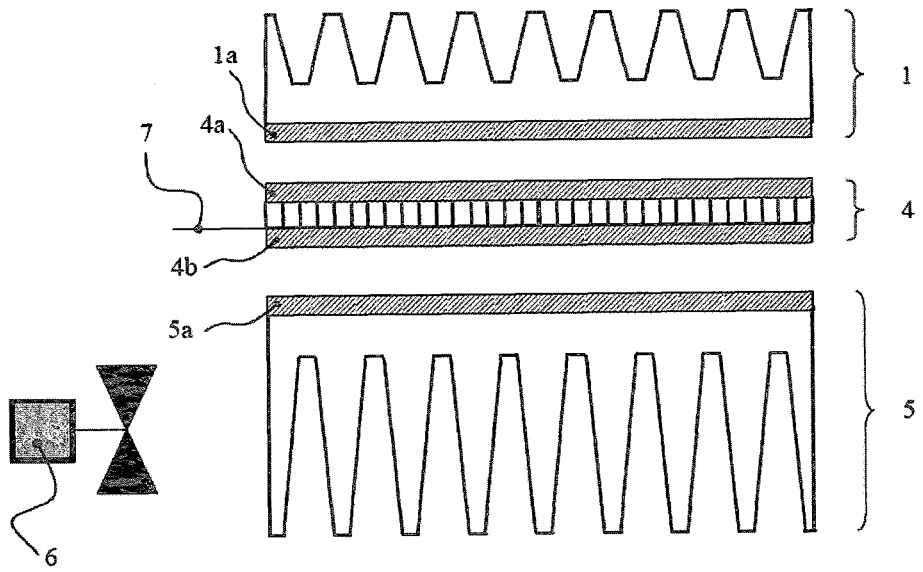
FIGS. 4A, 4B, 4C, 4D and 4E show a cross-sectional and exploded view of yet another embodiment of a device for heating and cooling according to the invention.
Figure 4B:
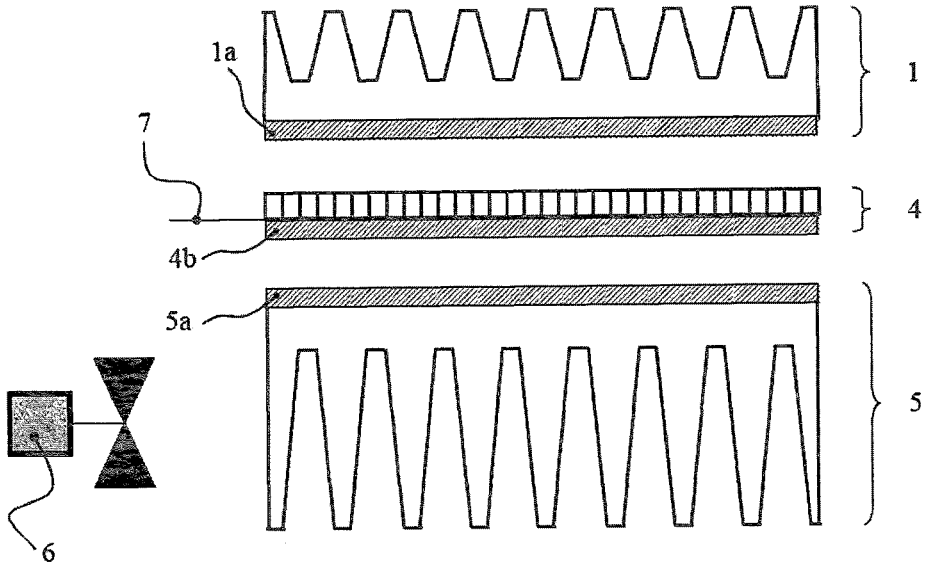
Figure 4C:
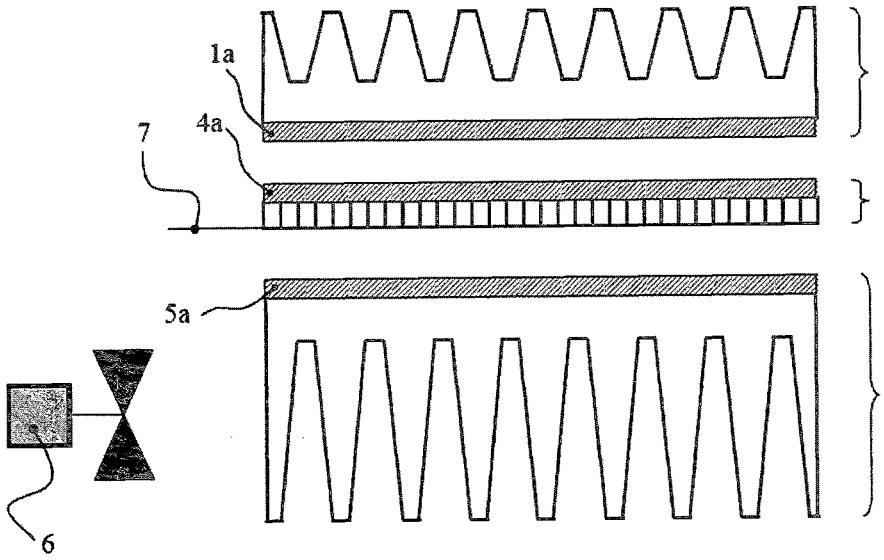
Figure 4D:
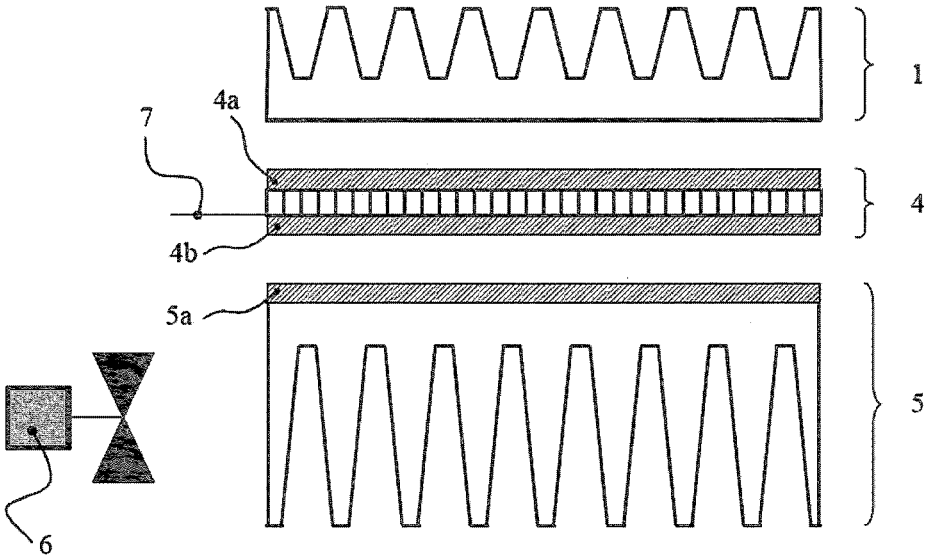
Figure 4E:
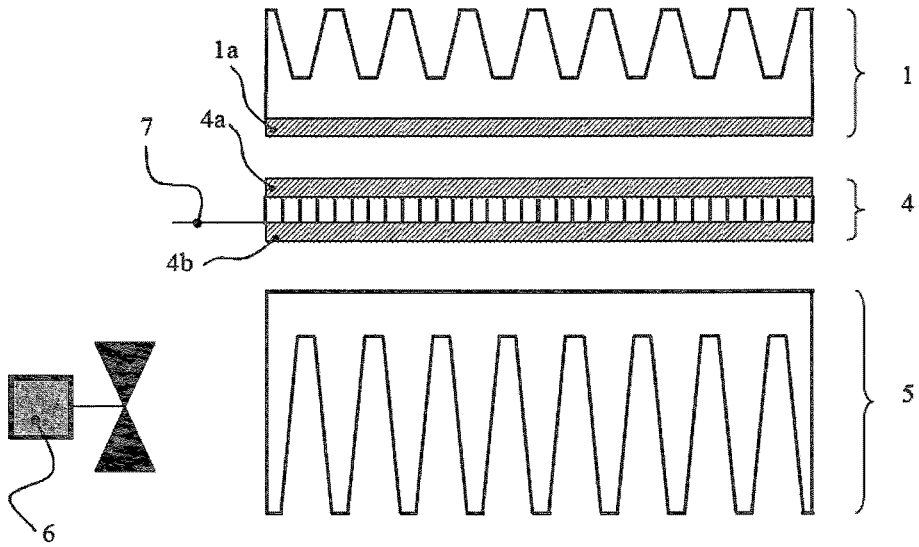

FIG. 2 displays a device for heating and cooling according to the invention having a thermal block (1), an element for heating and cooling (4), and a heat sink (5), wherein the surface of the thermal block facing the element for heating and cooling (1*a*) (FIG. 2A), the surface of the element for heating and cooling facing the thermal block (4*a*) (FIG. 2B), or both surfaces (1*a* and 4*a*) (FIG. 2C) are covered with a solid film lubricant, while the surface of the element for heating and cooling facing the heat sink (4*b*) and the surface of the heat sink facing the element for heating and cooling (5*a*) are not covered with a solid film lubricant.

FIG. 3 depicts a device for heating and cooling according to the invention having a thermal block (1), an element for heating and cooling (4), and a heat sink (5), wherein the surface of the thermal block facing the element for heating and cooling (1*a*) and the surface of the heat sink facing the element for heating and cooling (5*a*) (FIG. 3A), the surface of the element for heating and cooling facing the thermal block (4*a*) and the surface of the heat sink facing the element for heating and cooling (5*a*) (FIG. 3B), the surface of the thermal block facing the element for heating and cooling (1*a*) and the surface of the element for heating and cooling facing the heat sink (4*b*) (FIG. 3C) or both major surfaces of the element for heating and cooling (4*a* and 4*b*) (FIG. 3D) are covered with a solid film lubricant.

FIG. 4 shows a device for heating and cooling according to the invention having a thermal block (1), an element for heating and cooling (4), and a heat sink (5), wherein all major surfaces facing one another (1*a*/4*a* and 4*b*/5*a*) (FIG. 4A) or both major surfaces of one interface and one major surface of the other interface (1*a*, 4*b*/5*a*; 1*a*/4*a*, 5*a*; 4*a*, 4*b*/5*a*; 1*a*/4*a*, 4*b*) (FIG. 4B-E) are covered with a solid film lubricant.

Figure 5A:
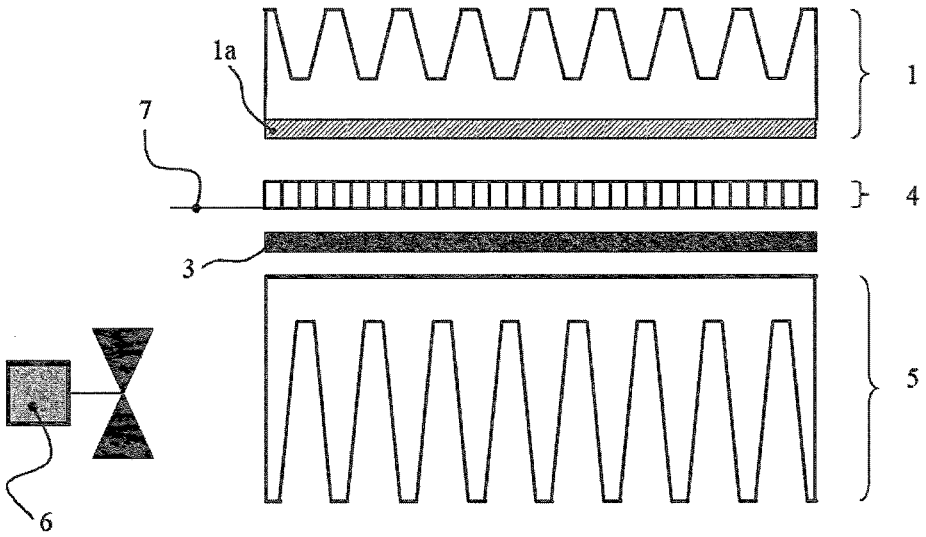
FIGS. 5A, 5B, and 5C show a cross-sectional and exploded view of still another embodiment of a device for heating and cooling according to the invention.
Figure 5B:
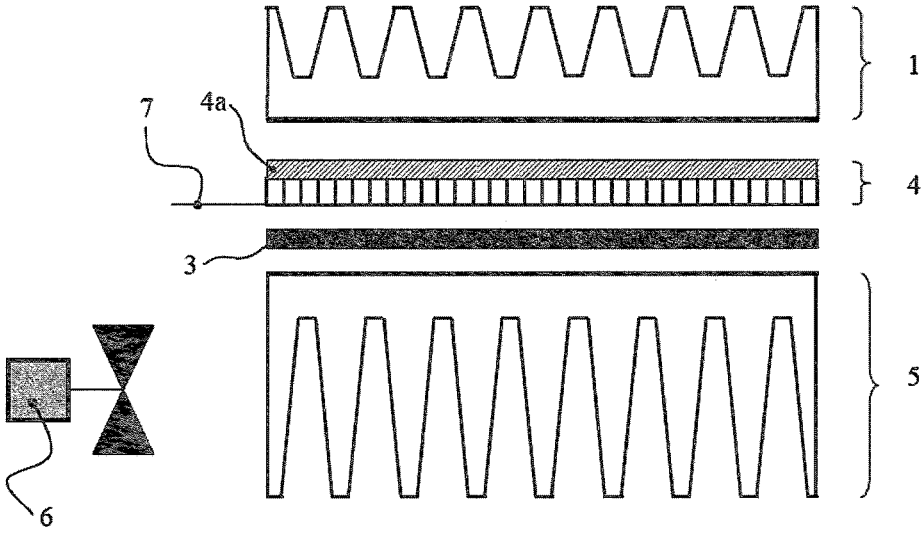
Figure 5C:
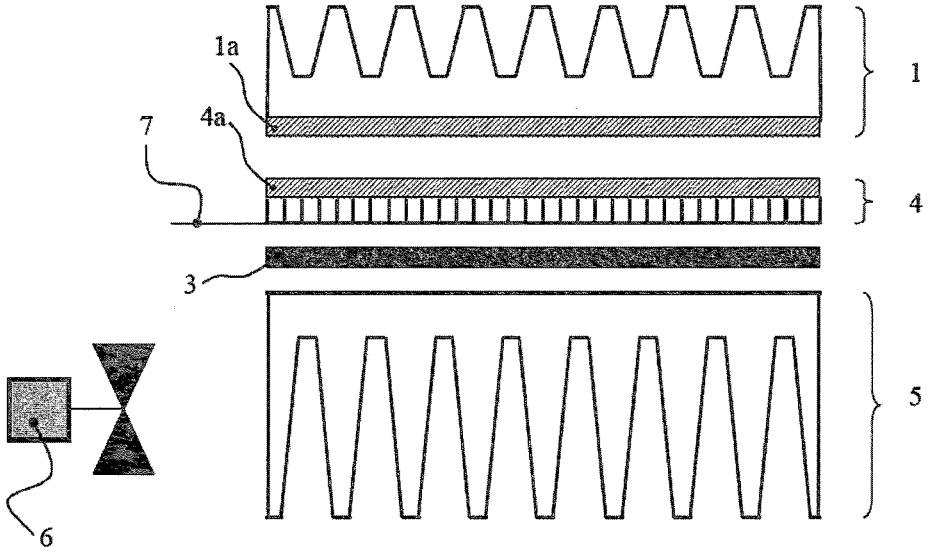

FIG. 5 displays a device for heating and cooling according to the invention having a thermal block (1), an element for heating and cooling (4), and a heat sink (5), wherein the surface of the thermal block facing the element for heating and cooling (1*a*) (FIG. 5A), the surface of the element for heating and cooling facing the thermal block (4*a*) (FIG. 5B), or both surfaces (1*a* and 4*a*) (FIG. 5C) are covered with a solid film lubricant and wherein a film for heat transfer (3) is present between the element for heating and cooling (4) and the heat sink (5).

For sake of clarity it should be pointed out that the components on the Figures are shown in a cross-sectional and exploded view where the elements are depicted separated for a better understanding. Therefore, the gaps shown between the components are not present when the device is assembled and in operation.

Further features and embodiments will become apparent from the description and the accompanying drawings. It will be understood that the features mentioned above and those described hereinafter can be used not only in the combination specified, but also in other combinations or on their own, without departing from the scope of the present disclosure.

As explained above, the present invention relates to a device for heating and cooling an object in a controlled manner and an instrument comprising such a device. The device comprises layered on top of another a thermal block, an element for heating and cooling, and a heat sink. The 'thermal block' forms the part of a thermal cycler that is capable of transferring heat to a receptacle holding the reaction mixture. In certain embodiments the thermal block comprises recesses for holding tubes containing the reaction mixture. However, a broad variety of 'receptacles' are known in the art comprising single tubes, tube strips, particular arrangements of single tubes in circular, linear or other geometric alignments, capillaries as well as multi-well plates (MWP) and are commonly made up from plastic materials or glass. The body of the thermal block of a thermal cycler is therefore typically adapted to the receptacle used in order to allow for a fast and efficient transition of heating or cooling energy. The thermal block is generally made up from a material having a high heat conductivity. The material may be a metal, in certain embodiments it is aluminum or silver. Silver has an improved heat conductivity while aluminum is more cost effective.

The temperature of the thermal block is raised and lowered via discrete, pre-programmed steps using an 'element for heating and cooling'. Such elements are well known in the art. An exemplary element for heating and cooling is a Peltier element. A Peltier element provides for a thermoelectric heating and cooling using the Peltier effect to create a heat flux between the junction of two different types of materials. Peltier elements are small solid-state devices that function as heat pumps. Typically a Peltier element is a few millimeters thick by a few millimeters to a few centimeters square. It is a sandwich formed by two ceramic plates with an array of small Bismuth Telluride cubes in between. When a direct current is applied heat is transported from one side of the device to the other. The cold side is commonly used to cool an electronic device. If the current is reversed the device makes an excellent heater.

The heat is removed on one side via a 'heat sink'. Heat sinks function by efficiently transferring thermal energy from an object at high temperature to a second object at a lower temperature with a much greater heat capacity. This rapid transfer of thermal energy quickly brings the first object into thermal equilibrium with the second, lowering the temperature of the first object, fulfilling the heat sink's role as a cooling device. Efficient function of a heat sink relies on rapid transfer of thermal energy from the first object to the heat sink. The most common design of a heat sink is a metal device with many fins. The high thermal conductivity of the metal combined with its large surface area result in the rapid transfer of thermal energy to the surrounding. In addition a fan may be used for additionally cooling the heat sink. Other embodiments of a heat sink comprise heat pipes usually in combination with a heat exchanging surface such as metal fins and a fan.

In order to allow for an efficient heat transfer from Peltier element to thermal block and/or the heat sink 'thermal interface materials' are used in the art. Such thermal interface materials may be applied as films, greases, epoxies, and pads and are selected in respect to their thermal and electrical conductivity, operating temperature range and expansion coefficient. It is used to fill the gaps between thermal transfer surfaces, such as between Peltier element and heat sink as well as between Peltier element and thermal block, in order to increase thermal transfer efficiency. These gaps are normally filled with air which is a very poor thermal conductor. Thermal interface materials are most commonly provided as white-colored paste or thermal grease, typically silicone oil filled with aluminum oxide, zinc oxide, boron nitride, pulverized silver, pulverized gold or beryllium oxide. Furthermore, paraffin/aluminum pads, boron nitride silicone sheets, graphite pads, adhesive polymer sheets, and silicone/fiberglass pads are used in the art.

Such a device for heating and cooling known in the art usable in a thermal cycler is depicted in FIG. 1 containing a thermal block (1), an element for heating and cooling (4), and a heat sink (5) additionally comprising a fan (6) for cooling the heat sink (5), wherein a film for heat transfer is present between the thermal block and the element for heating and cooling (2) as well as between the element for heating and cooling and the heat sink (3). In order to allow for an efficient heat transfer the elements making up the device are connected to another under mechanical force.

A particular problem of such devices for heating and cooling known in the art is that numerous thermal profiles are performed on such cyclers and that the thermal block (1) and the film for heat transfer (2) possess a diverse heat expansion coefficient. The heat expansion coefficient $\alpha$ for a thermal block made up from aluminum is known to be approximately $23\times10^{-6}$/K while the heat expansion coefficient $\alpha$ for the ceramic plates of a Peltier element comprising aluminum oxide is approximately $6\times10^{-6}$/K. This results in a vastly diverse expansion of the thermal block and the Peltier element each time heat is applied and thereby high shearing forces act on the film and the Peltier element itself. Thus, there is a high risk that these shearing forces may result in a disruption and disintegration or displacement of the film and thereby in an uneven heat transfer. Furthermore, if the film is made up from graphite which is capable of conducting electrical current also electrical malfunctions may occur. This problem becomes particularly apparent for large thermal blocks requiring the presence of more than one element for heating and cooling in order to provide for a homogenous temperature distribution across the thermal block. In such an embodiment a relative high difference of thermal expansion occurs between the Peltier element and the thermal block which may cause damage to the Peltier element if the shearing forces exceed the stability of the Peltier elements. A reduction of the shearing forces may be obtained by reduction of the force pressing the thermal block onto the Peltier elements or by using a thermal interface material with low friction.

In a device for heating and cooling according to the invention this problem is solved by omitting the film for heat transfer made up from thermal interface materials and by coating at least the surface of the thermal block facing the element for heating and cooling and/or the surface of the element for heating and cooling facing the thermal block with a solid film lubricant. By coating at least one of the surfaces that are brought into physical contact when the device for heating and cooling is assembled with a solid film lubricant the friction forces arising between the thermal block and the element for heating and cooling are drastically reduced. Thus, the risk for destruction of the element for heating and cooling and/or the surface of the thermal block is highly reduced.

As used herein, the term 'solid film lubricant' is used for materials that are applied either from the gas phase or from the liquid phase at approximately ambient temperature to a maximum temperature of about 130° C. onto a surface and which are characterized by a low friction coefficient. Furthermore, such solid film lubricants contain or consist of organic compounds, wherein the organic compounds may serve as adhering partners to the base material and/or serve as structural matrix and/or serve as the low friction partner. Such polymers are made up from poly-tetrafluoroethene or poly-tetrafluoroethylene (PTFE), polyimide, parylene F, fluorinated ethylene propylene (FEP) or other fluorine containing polymers or any mixture thereof. The solid film lubricant may be homogeneous or may contain organic or inorganic lubricant particles such as graphite, graphite-fluoride and/or molybdenum compounds such as $MoS_2$. However, coatings with an inorganic matrix such as nickel poly-tetrafluoroethylene (Ni-PTFE) are not considered to be solid film lubricants within the scope of this invention. Solid film lubricants may be hard or soft. A solid film lubricant is called hard when the solid film lubricant is applied on a glass substrate and a pencil with a hardness of 4H will not give a distinct indention if scratched over the surface. Examples for hard solid film lubricants are diamond-like carbon (DLC) or micro crystalline diamond films, which are applied from the gas phase or the sol-gel coating SC 95 (Surface Contacts GmbH Saarbrücken, Germany). Soft solid film lubricants are for example parylene F films, applied from the gas phase or the PTFE containing coating SC 11 (Surface Contacts GmbH Saarbrücken, Germany).

The coating with the solid film lubricant exhibits a low thickness of 0.2-25 μm compared to approximately 150 μm thickness of a typical thermal interface material made of graphite and thereby the heat transmission is only minimally affected. It could even be shown that the heat transmission resistance of a coating with the solid film lubricant is clearly reduced when compared to the heat transmission resistance of a film for heat transfer made up from graphite. Thus, the device according to the invention besides reducing the risk for an electronic or thermal malfunction is also advantageous regarding a fast heat transfer from the element for heating and cooling to the thermal block and vice versa as well as from the element for heating and cooling to the heat sink and vice versa.

In particular embodiments a soft solid film lubricant may be used on the softer surface or a hard solid film lubricant on the harder surface. If the element for heating and cooling is a Peltier element then the solid film lubricant on the ceramic plate of the Peltier element may be a hard solid film lubricant. The thermal block may be made from aluminum or silver and constitutes the less hard substrate. Therefore, a soft solid film lubricant may be used when coating the thermal block surface facing the element for heating and cooling. Using a hard solid film lubricant as for example DLC on a soft surface such as aluminum is also feasible but may to some extend bear the risk of damaging the solid film which then may compromise the intended friction reduction.

In certain embodiments it is sufficient to use a solid film lubricant coating only on the surface of the thermal block, particularly on the surface facing the element for heating and cooling (1*a*) as shown in FIG. 2A. Such embodiments are advantageous as frictional resistance between the thermal block and the element for heating and cooling are reduced, while the element for heating and cooling may remain uncoated. In a certain embodiment the complete thermal block is coated with a soft solid film lubricant in addition leading to an improved removability of the reaction vessels from the thermal block.

In another embodiment a solid film lubricant coating is applied only on the surface of the element for heating and cooling facing the thermal block (4*a*) as shown in FIG. 2B. This embodiment is advantageous due to the relative small volume of the element for heating and cooling compared to the volumes of the thermal block, which allows comparably simple mass production at the coating step.

In yet another embodiment a solid film lubricant coating is applied on the surface of the thermal block facing the element for heating and cooling (1*a*) as well as on the surface of the element for heating and cooling facing the thermal block (4*a*) as shown in FIG. 2C. In such an embodiment both interacting surfaces contribute to the reduction of the friction.

In the embodiments shown in FIG. 2 no solid film lubricant is coated on the surface of the element for heating and cooling facing the heat sink nor on the surface of the heat sink facing the element for heating and cooling. Beyond that no thermal interface material is placed between the element for heating and cooling and the heat sink. This is feasible if the relevant surfaces are very precisely flat and smooth and if there is excess cooling power so that there develops only marginal temperature differences between the two surfaces. In order to obtain more robust embodiments one may apply solid film lubricant on one or both of the relevant surfaces of the element for heating and cooling and the heat sink facing another as for example shown in FIGS. 3 A-D and 4 A-D or to place a thermal interface material in between the surface of the element for heating and cooling and the heat sink facing another as shown in FIG. 5 A-C.

In particular embodiments both surfaces in physical contact with another when the device is assembled are coated with different solid film lubricants. For example the surface of the thermal block facing the element for heating and cooling may be coated with a soft layer of a solid film lubricant (e.g., a coating based on poly-tetrafluoroethene or poly-tetrafluoroethylene (PTFE)) and the surface of the element for heating and cooling facing the thermal block may be coated with a hard layer of a the solid film lubricant (e.g., a diamond-like carbon (DLC)).

In other embodiments both surfaces in physical contact with another when the device is assembled are coated with identical solid film lubricants. For example the surface of the thermal block facing the element for heating and cooling and the surface of the element for heating and cooling facing the thermal block may both be coated with a soft layer of a the solid film lubricant (e.g., a coating based on poly-tetrafluoroethene or poly-tetrafluoroethylene (PTFE)) or may both be coated with a hard layer of a the solid film lubricant (e.g., a diamond-like carbon (DLC)), respectively.

These embodiments are advantageous as the coated elements for heating and cooling exhibit an improved durability due to reduced frictional resistance. Furthermore, the coating of the major surfaces of the element for heating and cooling can be performed by methods very well known in the art.

An instrument for performing thermal cycles commonly comprises a thermal block having a top surface and a plurality of recesses communicating with said top surface for holding plastic reaction vessels wherein reaction mixtures can be contained. The footprint of the thermal block is in the range of some cm in square. In particular embodiments the footprint is suitable for a plurality of vessels in the format of a multi-well plate. The opening of each vessel is closed, for example with a transparent closure that allows examination of the vessel content e.g. by measuring the light emission emitted by fluorescent dyes. A frame with corresponding apertures is placed above the plurality of vessels and pressed towards the thermal block, causing intimate contact of the plastic vessels with the surface of the recesses in the thermal block. In certain embodiments the frame is heated in order to heat the closures and avoid condensation of liquid at the closures.

The thermal block is stacked on top of an element for heating and cooling and a heat sink as schematically shown in FIG. 2-5. Fixture means e.g. spring loaded screws are used to press the stack together. A fluid is brought into contact with a heat exchanging surface of the heat sink in to order to transport away the excess heat. In certain embodiments the fluid is air and at least one fan blows air over the fins of the heat sink.

Sensors in the thermal block measure the temperature of the thermal block and a programmable electronic unit controls the heating and cooling of the heating and cooling element in order to perform a temperature profile within the reaction mixture in the reaction vessels.

For monitoring the progress of a reaction in the reaction vessels a certain embodiment of an instrument comprises a continuous or semi-continuous working detection system and a data processing unit comprising an entry unit, a display unit, a storage unit and auxiliary units which are state of the art to handle, store, retrieve and display the detection data together with other process data in a usable form. An example of detection system is fluorescence detection which is well known in the art.

The instrument according to the invention comprises a device for heating and cooling as described above, wherein at least one of the surfaces of the thermal block and/or the element for heating and cooling are coated with a solid film lubricant. The device for heating and cooling is positioned within the instrument in such a manner to permit a defined and predetermined physical interaction with a receptacle, when said receptacle is inserted into the instrument and brought into contact with said device. In certain embodiments the instrument comprises a heat control. In addition an instrument according to the invention may further comprise a housing, a power supply, supply and disposal means for other media as cooling air and/or pressurized air and/or cooling water and/or vacuum, auxiliary means for handling reaction vessels and for control and maintenance.

The device for heating and cooling as described above may also be used in a method for conducting a thermal profile comprising, wherein a receptacle is provided on a thermal block of a device for heating and cooling according to the invention, a fluid to be heated and/or cooled is provided in said receptacle, and heat or cold is applied to said fluid in said receptacle using said element for heating and cooling. The thermal profile may contain repeated thermocycles, which in certain aspects are suitable for performing a polymerase chain reaction and wherein the fluid to be heated is a reaction mixture for performing a polymerase chain reaction containing a nucleic acid sample to be amplified Various implementations are schematically illustrated in the drawings and are hereinabove explained in detail with reference to the drawings. It is understood that both the foregoing general description and the following examples of various embodiments are exemplary and explanatory only and are not meant to be restrictive or to be read into the claims. The accompanying drawings, which are incorporated in a constitutive part of this specification, illustrate some embodiments, and together with the description serve to explain the principles of the embodiments described herein.

EXAMPLES

Example 1

Application of a Hard Solid Film Lubricant on a Thermal Block

The rear side of a thermal block made up from aluminum enabling the physical contact with the Peltier element was coated under vacuum conditions with a Diamond-like carbon (DLC) to form a layer having a thickness of 0.5 μm, while the temperature of the thermal block was approximately 130° C.

Example 2

Application of a Hard Solid Film Lubricant on a Device for Heating and Cooling

In analogy to Example 1 the surface of a Peltier element (Marlow Industries, Inc. Dallas, Tex., USA) was coated under vacuum conditions with a Diamond-like carbon (DLC) to form a layer having a thickness of 0.5 μm, while the temperature of the Peltier element was not raised above 125° C.

Example 3

Application of a Hard Solid Film Lubricant on a Thermal Block

The rear side of a thermal block made up from aluminum enabling the physical contact with the Peltier element was coated with the sol-gel hard coating SC 95 (Surface Contacts GmbH Saarbrücken, Germany) using a spray coating method known in the art to form a layer having a thickness of 6 μm. After the application the coating on the thermal block was stove for 0.5 h at 125° C.

Example 4

Application of a Hard Solid Film Lubricant on a Device for Heating and Cooling

In analogy to Example 3 the surface of a Peltier element (Marlow Industries, Inc. Dallas, Tex., USA) providing heat was coated with the sol-gel hard coating SC 95 (Surface Contacts GmbH Saarbrücken, Germany) using a spray coating method known in the art to form a layer having a thickness of 6 μm. After the application the coating on the thermal block was stove for 0.5 h at 125° C.

Example 5

Application of a Soft Solid Film Lubricant on a Thermal Block

The rear side of a thermal block made up from aluminum enabling the physical contact with the Peltier element was coated with SC 11 (Surface Contacts GmbH Saarbrücken, Germany), a solid film lubricant containing poly-tetrafluoroethylene (PTFE), using a spray coating method known in the art to form a layer having a thickness of approximately 16 μm. After the application the coating was dried for 0.5 h at 280° C.

Example 6

Application of a Soft Solid Film Lubricant on Device for Heating and Cooling

In analogy to Example 5 the surface of a Peltier element (Marlow Industries, Inc. Dallas, Tex., USA) providing heat was coated with SC 11 (Surface Contacts GmbH Saarbrücken, Germany), a solid film lubricant containing poly-tetrafluoroethylene (PTFE), using a spray coating method known in the art to form a layer having a thickness of approximately 16 μm. After the application the coating was dried for 6 h at 125° C.

Example 7

Analysis of a Device for Heating and Cooling Known in the Art

A device for heating and cooling comprising a thermal block for accepting reaction vessels in form of microtiter plates, six Peltier elements (Marlow Industries, Inc. Dallas, Tex., USA), a film for heat transfer having a thickness of approximately 160 μm and being made up from graphite, and a heat sink was assembled in the described order using screws providing a surface compression of 700 N/cm$^2$. In addition the thermal block was covered with a coating made up from Nickel poly-tetrafluoroethylene (Ni-PTFE) having a thickness of approximately 25 μm. Using an electronic control the device for heating and cooling was subjected to repeated thermal cycles resembling typical PCR cycles. After approximately 1000 cycles the film for heat transfer was displaced from its reference position between the thermal block and the Peltier element leading to a short-circuit in the power supply of the Peltier element.

Example 8

Analysis of a Device for Heating and Cooling Having No Film for Heat Transfer

An assembly as described in Example 7 was provided except that no film for heat transfer was incorporated. Using an electronic control the device for heating and cooling was subjected to repeated thermal cycles resembling typical PCR cycles. After less than 1000 cycles the thermal block showed massive disintegration of the surface in contact with the Peltier element having depth up to approximately 0.5 mm.

Example 9

Assembly for a Fast Thermal Cycle Simulation

In order to allow for a fast examination of durability and lifespan of elements for heating and cooling a thermal block, a Peltier element, a graphite film thermal interface material and a heat sink were mounted on top of another in said order into a piling under a tension force of 700 N/cm$^2$. In order to examine the impact of various measures to improve the lifespan of the element for heating and cooling the Peltier element was mechanically moved back and forth parallel to its major surfaces for 0.5 mm at a frequency of 2 Hz and a constant temperature of 95° C. In this assembly, one movement back and forth represents the simulation of the relative movement of the Peltier element in relation to the thermal block caused by different heat expansion coefficients during one thermal cycle of a PCR.

Example 10

Analysis of a Device for Heating and Cooling Having No Film for Heat Transfer Using the Assembly for a Fast Thermal Cycle Simulation The element for heating and cooling known in the art and as described in Example 7 and 8 was subjected to the treatment in the assembly for fast thermal cycle simulation as outlined in Example 9. After less than 1000 cycles the thermal block showed massive disintegration of the surface in contact with the Peltier element having depth up to approximately 0.5 mm confirming the results outlined in Example 8.

Example 11

Analysis of a Device for Heating and Cooling According to the Invention Using the Assembly for a Fast Thermal Cycle Simulation The device for heating and cooling as described in Example 5 was subjected to the treatment in the assembly for fast thermal cycle simulation as outlined in Example 9. The surface of the thermal block made up from aluminum facing the Peltier element and enabling the physical contact with the Peltier element was coated with SC 11 (Surface Contacts GmbH Saarbrücken, Germany). No film for heat transfer was present in between the Peltier element and the thermal block. After 102000 cycles the interacting surfaces were analyzed. Except for a minor carry over of the solid film lubricant SC 11 from the surface of the thermal block facing the Peltier element to the surface of the Peltier element facing the thermal block no disintegration of the surfaces was detected. In additional experiments the results were reproduced and no disintegration of the surfaces was detected at up to 200000 cycles.

Similar results were obtained using a device for heating and cooling comprising a thermal block according to Example 1 or 3 as well as comprising a Peltier element according to Example 2, 4 or 6.

Example 12

Analysis of a Device for Heating and Cooling According to the Invention Using the Assembly for a Fast Thermal Cycle Simulation The device for heating and cooling comprising a thermal block as described in Example 5 and a Peltier element as described in Example 4 was subjected to the treatment in the assembly for fast thermal cycle simulation as outlined in Example 9. The surface of the thermal block made up from aluminum facing the Peltier element and enabling the physical contact with the Peltier element was coated with SC 11 (Surface Contacts GmbH Saarbrücken, Germany), while the surface of the Peltier element facing the thermal block was coated with the sol-gel hard coating SC 95 (Surface Contacts GmbH Saarbrücken, Germany). No film for heat transfer was present in between the Peltier element and the thermal block. After 100000 cycles the interacting surfaces were analyzed. Except for a minor carry over of the solid film lubricant SC 11 from the surface of the thermal block facing the Peltier element to the surface of the Peltier element facing the thermal block no disintegration of the surfaces was detected. Beyond that the frictional force was further decreased compared to the device for heating and cooling used in Example 11 as the power input of the actuator in the assembly was reduced, which is indicative for the frictional force present in the assembly.

| Reference numerals | |
|---|---|
| 1 | thermal block |
| 1a | surface of the thermal block facing the element for heating and cooling |
| 2 | film for heat transfer |
| 3 | film for heat transfer |
| 4 | element for heating and cooling |

-continued

| Reference numerals | |
|---|---|
| 4a | surface of the element for heating and cooling facing the thermal block |
| 4b | surface of the element for heating and cooling facing the heat sink |
| 5 | heat sink |
| 5a | surface of the heat sink facing the element for heating and cooling |
| 6 | fan |
| 7 | circuit |

While the foregoing invention has been described in some detail for purposes of clarity and understanding, it will be clear to one skilled in the art from a reading of this disclosure that various changes in form and detail may be made without departing from the true scope of the invention. For example, the systems and methods described above may be used in various combinations. All publications cited in this application are incorporated by reference in their entirety for all purposes to the same extent as if each individual publications were individually indicated to be incorporated by reference for all purposes.

What is claimed is:

1. A device for heating and cooling an object in a controlled manner, said device comprising layered on top of another in the following order from top to bottom:

a thermal block, an element for heating and cooling, and a heat sink, wherein the surface of the thermal block facing the element for heating and cooling and/or the surface of the element for heating and cooling facing the thermal block is covered with a solid film lubricant.

2. The device according to claim 1, wherein the surface of the element for heating and cooling facing the heat sink and/or the surface of the heat sink facing the element for heating and cooling is further covered with a solid film lubricant.

3. The device according to claim 1, wherein said solid film lubricant is selected from the group consisting of:

homogeneous films containing a material selected from the group consisting of fluorine containing polymers, polyimide, microcrystalline diamond, diamond-like carbon (DLC), and mixtures thereof and, heterogeneous films comprising an organic matrix with organic or inorganic lubricant particles.

4. The device according to claim 3, wherein the fluorine containing polymer is selected from the group consisting of poly-tetrafluoroethene, poly-tetrafluoroethylene (PTFE), parylene F and fluorinated ethylene propylene (FEP).

5. The device according to claim 1, wherein two surfaces facing each other are coated with different solid film lubricants.

6. The device according to claim 1, wherein two surfaces facing each other are coated with identical solid film lubricants.

7. An instrument for performing thermal cycles comprising a device for heating and cooling according to claim 1.

8. An instrument according to claim 7, wherein said device is positioned within the instrument in such a manner to permit a defined and predetermined physical interaction with a receptacle when said receptacle is inserted into the instrument and brought into contact with said device.

9. An instrument according to claim 7 further comprising heat control means.

10. A method for conducting a thermal profile comprising:

providing a receptacle on a thermal block of a device for heating and cooling according to claim 1, providing a fluid to be heated and/or cooled in said receptacle, applying heat or cold to said fluid in said receptacle using said device for heating and cooling.

11. The method according to claim 10, wherein said thermal profile comprises repeated thermocycles.

12. The method according to claim 10, wherein the thermal profile is suitable for performing a polymerase chain reaction and the fluid to be heated is a reaction mixture for performing a polymerase chain reaction containing a nucleic acid sample to be amplified.

* * * * *